US005755607A

United States Patent [19]

Boatman et al.

[11] Patent Number: 5,755,607

[45] Date of Patent: May 26, 1998

[54] RISER MOUNTING ARRANGEMENT FOR A MORING SYSTEM

[75] Inventors: L. Terry Boatman, Houston; Richard D. Yetman, Tomball, both of Tex.

[73] Assignee: FMC Corporation, Chicago, Ill.

[21] Appl. No.: 845,593

[22] Filed: Apr. 25, 1997

[51] Int. Cl.[6] ..... B63B 22/02

[52] U.S. Cl. ..... 441/5; 114/230; 141/387

[58] Field of Search ..... 441/3–5; 114/230; 141/387

[56] References Cited

U.S. PATENT DOCUMENTS 4,490,121 12/1984 Coppens et al. ..... 441/5

*Primary Examiner*—Jesus D. Sotelo
*Attorney, Agent, or Firm*—Bush, Riddle, & Jackson L.L.P.

[57] ABSTRACT

An improved mooring system for a vessel (10) having a mooring turret (19) which is rotatably coupled to a well (14) of the vessel (10) such that the vessel (10) is free to weathervane about the mooring turret is disclosed. An anchor leg support base (18) is fixed with the mooring turret (19) with anchor lines (20) secured thereto and anchored to the sea floor (24). A riser turret (25) is rotatably coupled to the mooring turret (19) and is fixed to the well (14) of the vessel. A riser support base (100) is pivotally coupled to a riser support device (30) for mounting the upper ends of a plurality of flexible risers (48) extending from the sea floor. The riser mounting device (30) is arranged and designed to pivot about two axes (34, 40) at right angles to each other relative to the riser support base (100). The gimbaled riser mounting device (30) provides a generally uniform load distribution among the risers (48) upon twisting or bundling of the risers (48) which result from weathervaning of the vessel (10) about the mooring turret (19).

4 Claims, 4 Drawing Sheets

RISER MOUNTING ARRANGEMENT FOR A MORING SYSTEM

BACKGROUND OF THE INVENTION

1. Field of the Invention

This invention relates generally to a mooring system for a vessel rotatably supported from a mooring turret and having a riser turret also rotatably coupled to the mooring turret for supporting risers extending to the sea floor for the transport of hydrocarbon product such that a rotatable fluid coupling is avoided.

2. Description of Prior Art

Floating production and storage vessels receive hydrocarbon product from offshore subsea production wells via risers for the hydrocarbon products extending to the vessel. The vessel is rotatively mounted to a turret which is substantially secured to the sea bed by means of anchor legs. The vessel weathervanes about the turret under forces of wind, waves and currents. The risers normally extend to manifolds; and to a swivel stack that is normally mounted above the manifolds to receive the product from the risers. The swivel stack provides rotative fluid coupling between the fixed risers and the pipes which rotate with the weathervaning vessel. The pipes extend to storage areas or holds in the vessel.

Hydrocarbon production is now occurring in deeper waters where offshore production fields are often requiring systems capable of handling increased fluid pressures. Increased fluid pressure implies that a fluid swivel be of increased size and capability to accommodate the increased pressure. Increased size implies increased weight and cost. In an effort to obiate massive swivels, systems have been proposed to perform rotative fluid coupling between turret and vessel which require no swivel.

Such a system has been proposed in which an associated riser turret is mounted for rotation with the vessel for rotation about the mooring turret to eliminate the swivels or swivel stack as required heretofore. A riser "bundle" is established below the riser turret as the riser turret weathervanes with the vessel about the mooring turret. The riser "bundle" is a plurality of flexible risers which when rotated 360° or more, may under certain conditions, tend to bundle or wrap together to a limited extent, as the vessel weathervanes about the turret. When this occurs, an outer riser may be subjected to the loads of several risers because the load from the bundle of risers may be primarily exerted through a single riser, particularly from the frictional contact between the risers when in a twisted or bundled relation. Thus, when risers twist into a bundle, they act as one unit with each individual riser unable to move relative to adjacent risers. As a result, the weight of the bundle may be suspended by a single riser located on the high tension side of the bundle.

Identification of Object of the Invention

It is an object of the present invention to provide a mounting arrangement for risers leading to a riser turret which permits a generally uniform distribution of load among the multiple risers in a group of risers.

SUMMARY OF THE INVENTION

The invention is for an improvement in a mooring system having a mooring turret extending upwardly from an anchor leg support base. The mooring turret is rotatably supported by a bearing system in a well of the vessel. Thus the vessel is free to weathervane about the mooring turret which is substantially fixed to the sea bed. An internal riser turret is placed coaxially within the mooring turret and is rotatably supported from the mooring turret. The riser turret is coupled to the well of the vessel. Accordingly the riser turret is free to rotate, with the vessel, about the substantially fixed mooring turret.

A riser support base is secured at the bottom of the riser turret. Such riser support base secures risers from the sea floor and provides connections to riser tubes in the riser turret. Accordingly, such riser support base rotates with the vessel, with the result that risers below the support base twist together into a bundle with rotation of the vessel. Fluid conduits extend from the top of the riser turret to pipes in the vessel leading to storage holds.

The improvement according to the invention includes a universal type joint lower riser mounting device for terminating risers from the sea floor and connecting them to the riser support base. The improvement also includes flexible conduits disposed between risers terminated at the lower riser mounting device and riser tubes which terminate at the riser support base.

DESCRIPTION OF PREFERRED EMBODIMENT

Figure 1:
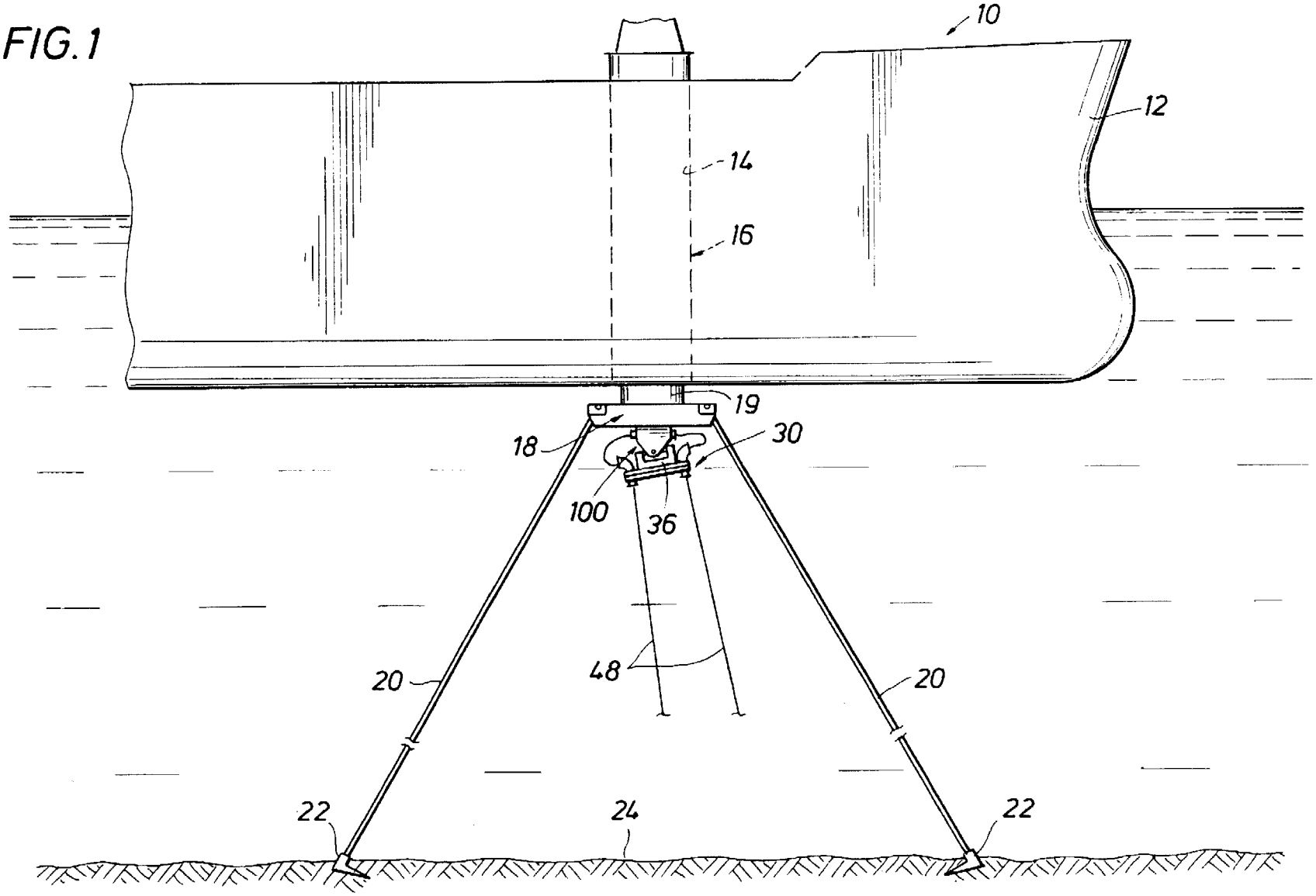
FIG. 1 is an elevation view of a vessel having a riser mounting device of the invention pivotally suspended from the lower side of a riser support base with a mooring line support base anchored to the sea floor and mounted for rotation relative to the riser mounting device.
Figure 2:
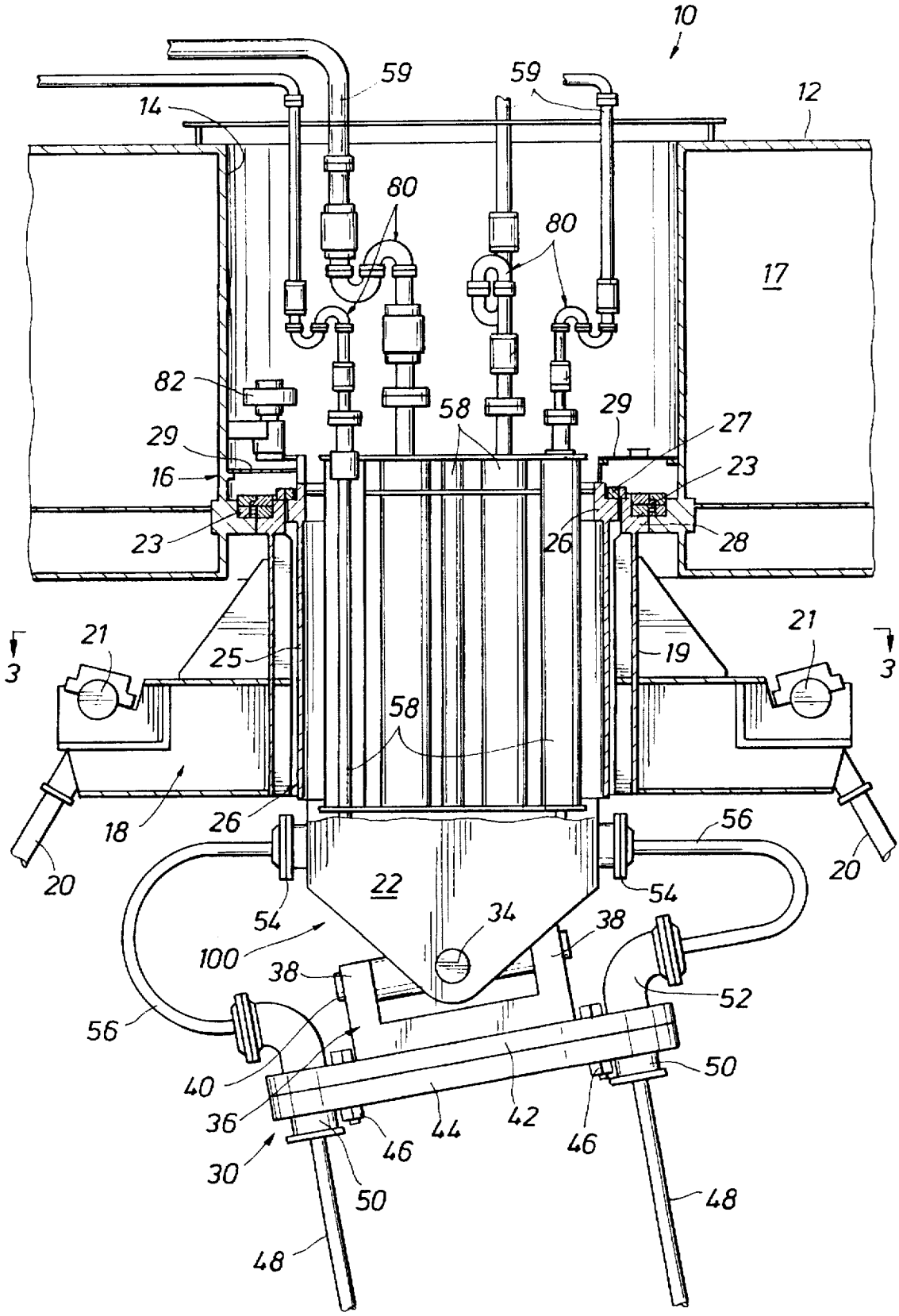
FIG. 2 is a longitudinal, partially sectioned view of a mooring system including the present invention in which a riser turret and risers are fixed to the vessel for rotating with the vessel about a mooring line support base anchored to the sea floor.

Referring now to the drawings for a better understanding of the invention, a vessel 10 has a body or hull 12 in which a vertical opening or well 14 is provided. FIGS. 1 and 2 show that turret 19 extends upwardly form an anchor leg support base 18. A plurality of anchor lines 20 have their upper ends 21 secured to anchor leg support base 18. Anchor lines 20 are anchored to the sea floor 24 by suitable anchors 22. A bearing assembly 23 rotatably supports the vessel hull to a mooring turret annular shoulder 28. See FIG. 4.

An internal riser turret 25 is placed coaxially within mooring turret 19. Internal riser turret 25 includes a riser turret annular shoulder 26 which is supported as shown also in FIG. 4 on mooring turret annular shoulder 28. An upper annular cover plate 29 is secured between the riser turret 25, via annular shoulder 26 and a connection to a vertical extension 26', and the well 14 of hull 12. As a result the internal riser turret 25 is free to rotate about mooring turret 19 when the vessel rotates during its weathervaning about mooring turret 19. A riser support base 100 extends downwardly from riser turret 25 and includes a pair of parallel arms 22. A lower riser mounting device shown generally at 30 is suspended for pivotal movement about a horizontal pivot pin 34 extending between arms 22 of bracket 100. Riser mounting device 30 also includes a bracket 36 including spaced parallel arms 38 and a pivot pin 40 which form a gimbal or universal joint with bracket 100. Bracket 36 is mounted on the upper surface of a pair of mounting plates or flanges 42, 44 secured to each other by suitable fasteners 46.

A plurality of flexible risers 48 extend from subsea wells (not illustrated) on sea floor 24. The risers 48 are connected axially with downwardly extending rigid pipe ends 50 secured to lower plate 44. Curved rigid pipe ends 52 are secured to upper plate 42 for each riser 48. The internal riser turret 25 includes rigid horizontal pipe ends 54 at its bottom end associated with each rigid curved pipe end 52. A flexible riser hose 56 is connected between each pair of associated pipe ends 52, 54. Rigid vertical riser sections 58 mounted on riser turret 25 have lower ends connected to horizontal pipe ends 54. Upper ends of riser sections 58 are connected to suitable conduits 59 running to suitable product storage areas, or holds in vessel 10. Flexible hoses 56 are arranged and designed to be a proper length to provide partial loops in order to permit pivotal movement of rigid curved ends 52 relative to rigid pipe ends 54 which extend laterally from riser turret 25.

Figure 4:
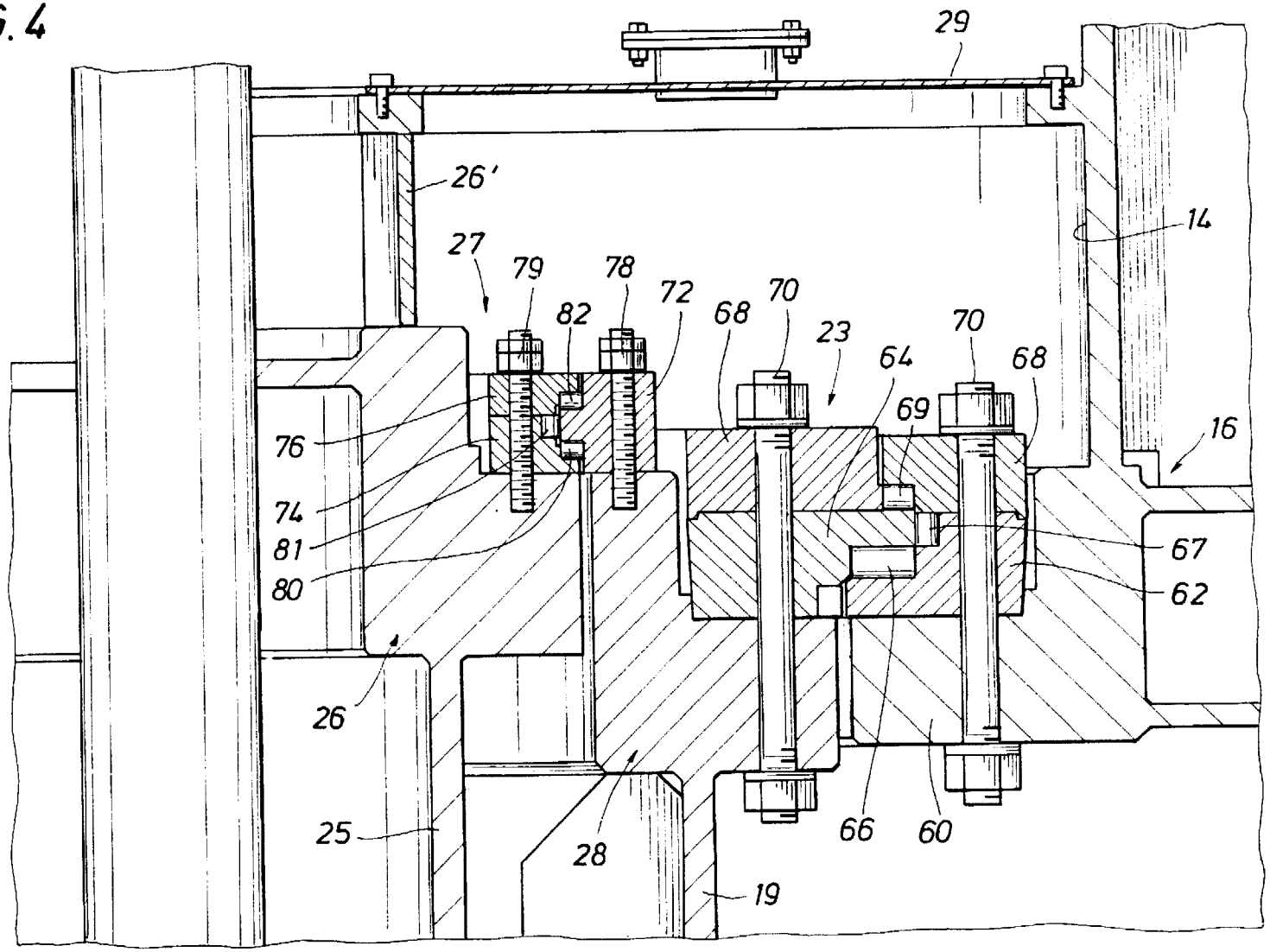
FIG. 4 is an enlarged sectional view of the bearing arrangement for mounting the mooring line support base for rotation concentrically between the turret and riser support base.

Referring specifically to FIG. 4, bearing structures 23 and 27 for mooring turret 19/annular shoulder 28 and riser turret 25/annular shoulder 26 are illustrated. Bearing structure 23 provides vertical and radial bearing support between bearing support shoulder 60 of well 14 of hull 12 and adjacent annular shoulder 28 of turret 19. Bearing structure 23 includes lower bearing races 62, 64 on respective well bearing support shoulder 60 and mooring turret annular shoulder 28. Roller bearings 66 are mounted horizontally for axial support; roller bearings 67 are mounted vertically for radial support therebetween. Upper thrust bearing races 68 are secured by suitable studs 70 to well 14 and mooring turret 19. Upper bearings 69 are horizontally mounted between races 64 and 68.

Bearing structure 27 includes bearing race 72 on mooring turret 19/annular shoulder 28 which is fastened by threaded studs 78. A lower bearing race 74 disposed on riser turret 25/annular shoulder 26 and an upper thrust bearing race 76 are secured by studs 79 to annular shoulder 26. Axial roller bearings 80, 82 are horizontally mounted between races 72 and 74 and between races 72 and 76. Radial bearings 81 are vertically mounted between races 72 and 74. Because the well 14 of vessel 10 is connected to riser turret 25 via cover plate 29, vertical extension 26' and riser turret annular shoulder 26, the vessel 10 and riser turret 25 turn together about mooring turret 19 when the vessel 10 weathervanes about mooring turret 19. The universal joint formed by pivot pins 34 and 40 provide pivotal movement of lower riser mounting device 30 in two separate planes at right angles to each other in order to provide a generally uniform load distribution among the plurality of risers 48 which bundle together when they are twisted as the vessel 10 rotates about turret 19. Riser mounting device 30 may pivot about axes defined by pivot pins 34 and 40 as much as about ten (10°) to fifteen (15°) degrees relative to the longitudinal axis of riser turret 25.

When risers 48 twist into a bundle upon rotation of vessel 10 and riser mounting device 30 relative to mooring riser 19, riser mounting device 30 tilts or pivots relative to riser turret 25 tending to reduce tensioning of the high tension side of the bundle of twisted risers 48. Thus, a substantially uniform load distribution on any riser of the bundle of twisted risers 48 is provided.

If risers 48 become twisted to such a great extent so as to provide a possible failure, quick disconnect couplings shown at 80 in FIG. 1 are provided for each of the pipes 59 connected to risers 48 above riser turret 25. Such disconnect couplings may be purchased from M.I.B. International, Limited, of Coventry, England or FMC Corporation of Houston, Tex. Also, disconnectable linkage arms (not shown) extending between vessel well 14 and riser turret 25 may be substituted for cover plate 29 if the mooring arrangement is designed for the occurrence of multiple rotations of the vessel 10 about mooring turret 19. Upon disconnection of the rigid riser lines 58 and disconnection of the linkage arms (not illustrated) from the riser turret, a hydraulic drive assembly shown at 82 in FIG. 2 is provided to unwind the riser turret 25 and risers 48 with respect to the mooring turret 19. After unwinding, the riser turret 25 is reconnected to well 14 by such linkage arms (not illustrated) and the riser sections 58 are reconnected to the vessel pipes 59.

Figure 3:
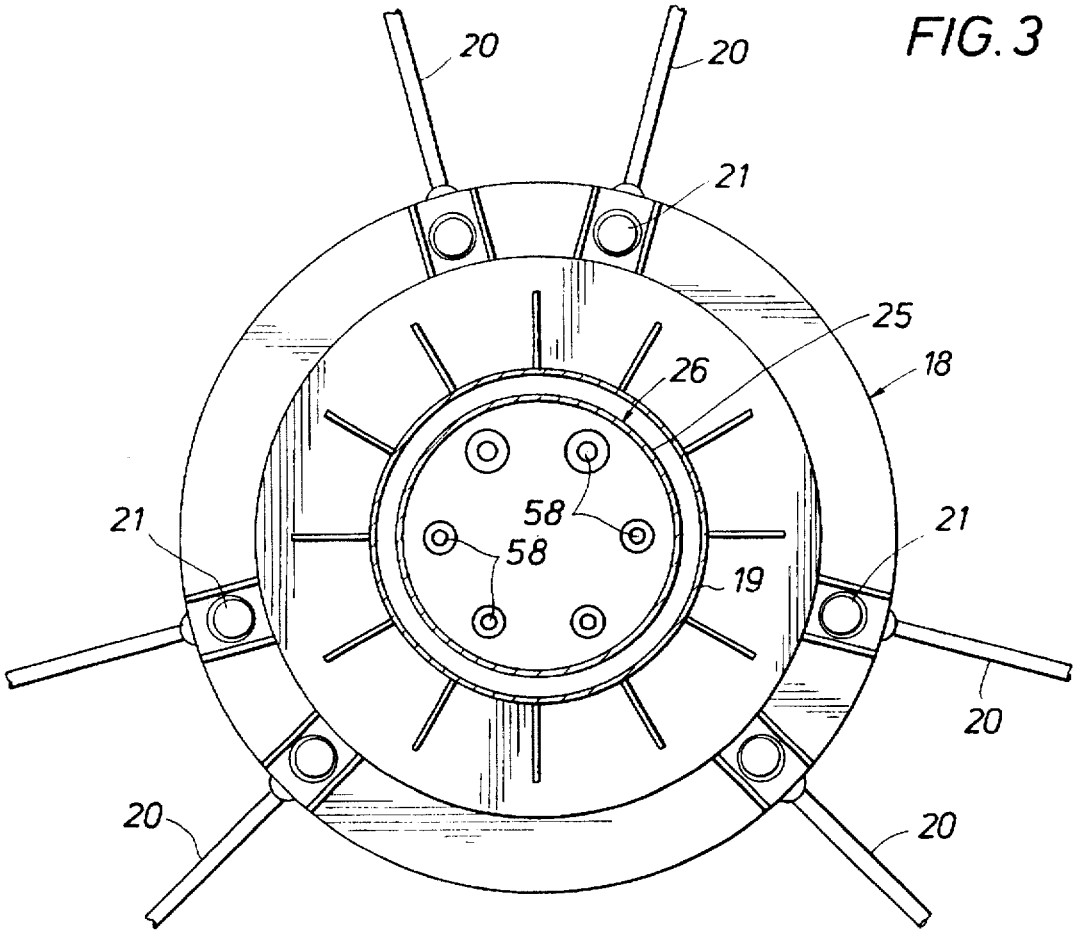
FIG. 3 is a top plan view taken generally along line 3—3 of FIG. 2.

While only six mooring lines 20 are shown in FIG. 3, twelve (12) or as many as about forty eight (48) or more mooring lines 20 spaced equally from each other or in groups may be utilized. Also, the number of risers 48 may vary substantially from project to project such as from two (2) to fifty (50) or more for example.

Figure 5:
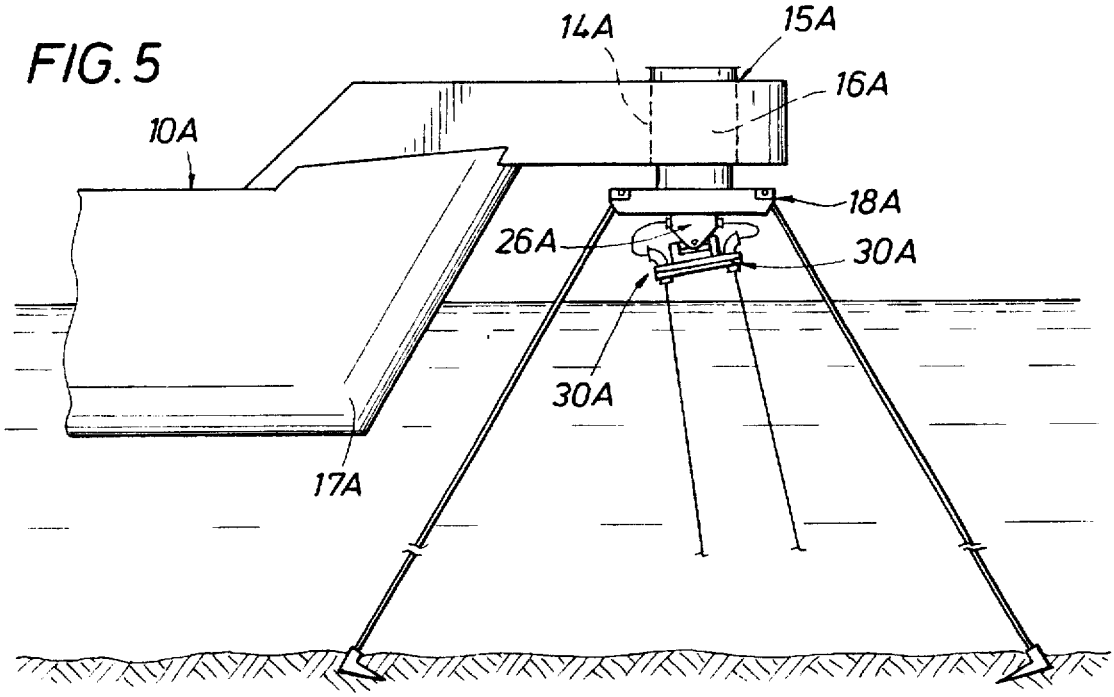
FIG. 5 is an elevation view of the present invention mounted on a cantilevered support structure extending from the bow of the vessel.

Description of Embodiment of FIG. 5

FIGS. 1–4 show the mooring turret and riser turret of the present invention arranged and designed for utilization with a turret rotatably supported within a vertical opening or well of the hull 12 of vessel 10. It may be desirable under certain conditions to embody the present invention in a bow mounted external type turret as shown in FIG. 5. A cantilevered support 15A extends form the bow 17A of vessel 10A. Support 15A has a vertical opening 16A. An anchor leg support base 18A is provided with riser support base 26A and riser mounting device 30A which are similar to anchor leg support base 18 and riser support base 26 in the embodiment of FIGS. 1–4.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. An improved riser and mooring structure for a vessel for supporting risers extending from the sea floor and having a mooring turret substantially fixed to the sea floor and rotatably coupled to the vessel such that the vessel may weathervane about the mooring turret and having a riser turret rotatably coupled to said mooring turret for rotation about said mooring turret, said riser turret having a riser support base for securing a plurality of fluid risers to said riser turret, where said risers extend between the sea floor and the vessel and which twist together below said riser turret when said vessel and said riser turret weathervanes about said mooring turret, said riser turret having riser sections which lead from terminations at said riser support base to pipes to storage holds on said vessel;

wherein the improvement compromises a riser mounting device pivotally suspended from said riser support base of said riser turret, said mounting device arranged and designed to couple the ends of said risers pivotally to said riser support base and to said riser sections in said riser turret.

2. The improvement of claim 1 wherein said riser mounting device includes flexible conduits coupled between said risers at said riser mounting device and said riser sections of said terminations at said riser support base.

3. The improvement of claim 1 wherein a universal joint couples said riser support base and said riser mounting device, whereby said riser mounting device can move about two axes at right angles to each other relative to said riser support base in response to twisting forces of said risers which are secured at said riser mounting device.

4. The improvement of claim 1 wherein rigid pipe portions are mounted on said riser support base and on said riser mounting device, and flexible riser portions extend between said rigid pipe portions to permit pivotal movement of said riser mounting device relating to said riser support base.

* * * * *